US008216426B1

(12) United States Patent
Urps

(10) Patent No.: US 8,216,426 B1
(45) Date of Patent: Jul. 10, 2012

(54) EXTRACTION BEDPLATE AND METHOD FOR MANUFACTURING AN EXTRACTION BEDPLATE

(75) Inventor: Darrell Urps, Greer, SC (US)

(73) Assignee: URPS, Inc., Greer, SC (US)

( * ) Notice: Subject to any disclaimer, the term of this patent is extended or adjusted under 35 U.S.C. 154(b) by 23 days.

(21) Appl. No.: 13/021,161

(22) Filed: Feb. 4, 2011

(51) Int. Cl.
*D21C 7/00* (2006.01)

(52) U.S. Cl. ..... 162/234

(58) Field of Classification Search ..... 162/28, 162/55, 234, 261; 100/104; 241/24.1, 46.02
See application file for complete search history.

(56) References Cited

U.S. PATENT DOCUMENTS 3,035,781 A * 5/1962 Wallen ..... 241/46.17
4,593,861 A * 6/1986 Blakley et al. ..... 241/46.02
4,885,090 A * 12/1989 Chupka et al. ..... 210/497.01
5,064,537 A * 11/1991 Chupka et al. ..... 210/497.01
6,053,439 A * 4/2000 Locke et al. ..... 241/20
7,628,890 B2 12/2009 Chupka et al.
2005/0039615 A1* 2/2005 Chupka et al. ..... 100/104
2007/0245907 A1* 10/2007 Chupka et al. ..... 100/104
2010/0065670 A1* 3/2010 Chupka et al. ..... 241/285.1

* cited by examiner

*Primary Examiner* — Mark Halpern

(74) *Attorney, Agent, or Firm* — Dority & Manning, P.A.

(57) ABSTRACT

An extraction bedplate includes a body and a plurality of apertures through the body. Each of the plurality of apertures includes a first end and a second end wider than the first end. At least three obtuse angles are in each of the first and second ends. A method for manufacturing an extraction bedplate includes creating a plurality of apertures through a body wherein each aperture comprises a first end, a second end wider than the first end, and at least three obtuse angles in each of the first and second ends.

20 Claims, 3 Drawing Sheets

EXTRACTION BEDPLATE AND METHOD FOR MANUFACTURING AN EXTRACTION BEDPLATE

FIELD OF THE INVENTION

The present invention relates generally to an extraction bedplate that may be incorporated into a pulper that mechanically and/or chemically processes the fibers of wood chips or artificial non-woven fibers to reduce them to pulp. Particular embodiments of the present invention may also relate to a method for manufacturing the extraction bedplate.

BACKGROUND OF THE INVENTION

Various machines are known in the art for removing fibers or otherwise processing papermaking stock. For example, a pulper generally includes a tub or other suitable container for holding and feeding a volume of the papermaking stock through an extraction bedplate generally located at the base or bottom of the tub. A rotor or other agitator churns or mixes the papermaking stock in the tub, causing the papermaking stock to abrasively flow over the extraction bedplate. As the papermaking stock flows over and rubs against the extraction bedplate, apertures in the extraction bedplate abrade or scrape against the papermaking stock, reducing the size of the papermaking stock and allowing the abraded stock pass through the extraction bedplate.

The size and geometry of the apertures are specifically designed to efficiently abrade and defiber the papermaking stock. For example, the size of the apertures effects the number of apertures that may be arranged on the extraction bedplate, and this the cutting surfaces exposed to the papermaking stock. Similarly, the geometry of the apertures effects the ability of the apertures to abrade and defiber the papermaking stock without becoming obstructed. Specifically, apertures having sharp edges and/or acute angles may enhance the abrasion of the papermaking stock by forming sharp cutting surfaces. However, a trade-off exists in that sharp-edged apertures tend to dull or wear out faster, and apertures having acute corners tend to collect papermaking stock, thereby clogging or obstructing the apertures. Therefore, continued improvements in the design and orientation of the apertures in the extraction bedplate would be useful.

BRIEF DESCRIPTION OF THE INVENTION

Aspects and advantages of the invention are set forth below in the following description, or may be obvious from the description, or may be learned through practice of the invention.

One embodiment of the present invention is an extraction bedplate that includes a body and a plurality of apertures through the body. Each of the plurality of apertures includes a first end and a second end wider than the first end. At least three obtuse angles are in each of the first and second ends.

Another embodiment of the present invention is an extraction bedplate that includes a body and a plurality of apertures through the body. Each of the plurality of apertures includes a first end and a second end wider than the first end. At least three obtuse angles are in each of the first and second ends, and at least one of the obtuse angles has a rounded vertex.

The present invention may also include a method for manufacturing an extraction bedplate. The method includes creating a plurality of apertures through a body wherein each aperture comprises a first end, a second end wider than the first end, and at least three obtuse angles in each of the first and second ends.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
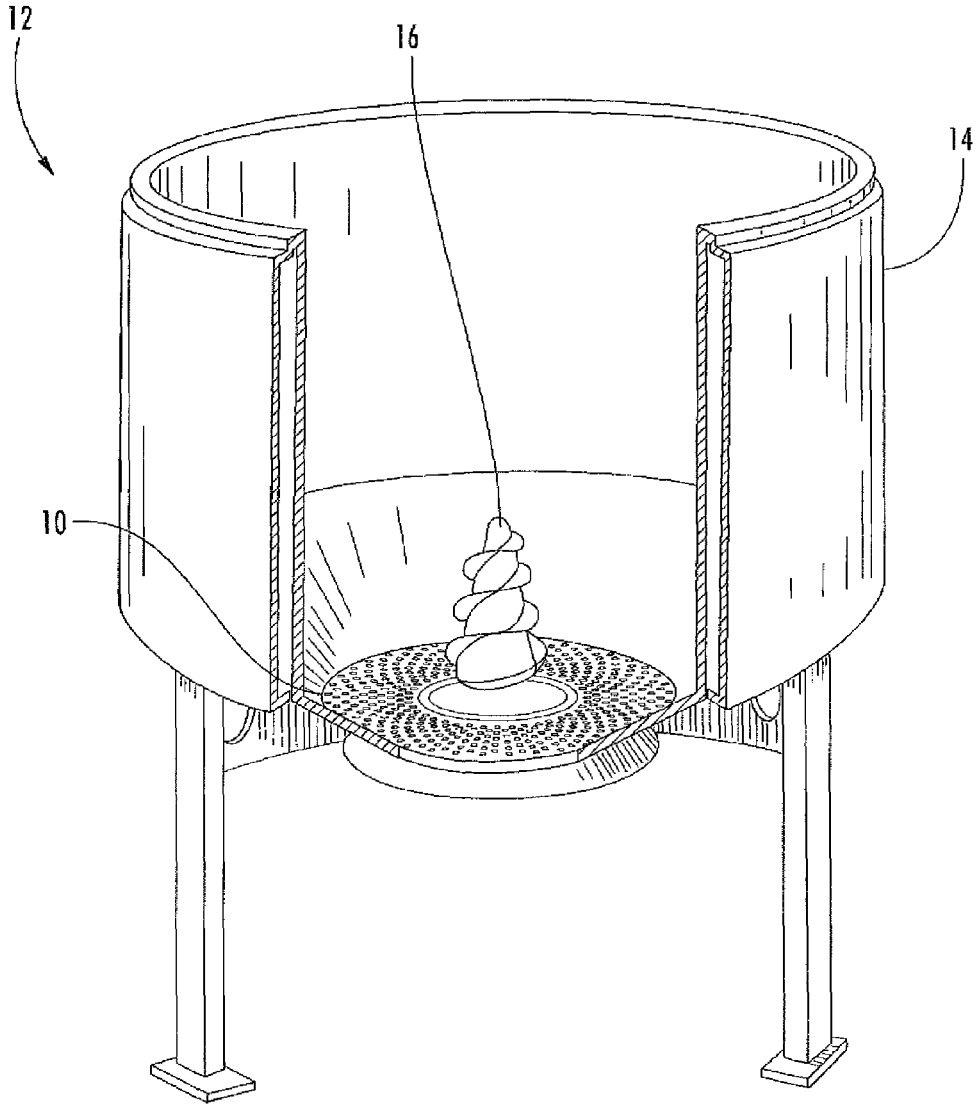
FIG. 1 is a partial cutaway of a simplified perspective view of a pulper according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide an extraction bedplate 10 for use in a pulper 12 and method for making the extraction bedplate 10. FIG. 1 provides a partial cutaway of a simplified perspective view of the pulper 12 according to one embodiment of the present invention. As shown, the pulper 12 generally includes a tub 14 or other suitable container for holding and feeding a volume of papermaking stock through the extraction bedplate 10 generally located at the base or bottom of the tub 14. A rotor 16 or other agitator churns or mixes the papermaking stock in the tub 14, causing the papermaking stock to abrasively flow over the extraction bedplate 10. As the papermaking stock flows over and rubs against the extraction bedplate 10, apertures 18 in the extraction bedplate 10 abrade or scrape against the papermaking stock, reducing the size of the papermaking stock and allowing the abraded stock pass through the extraction bedplate 10.

Figure 2:
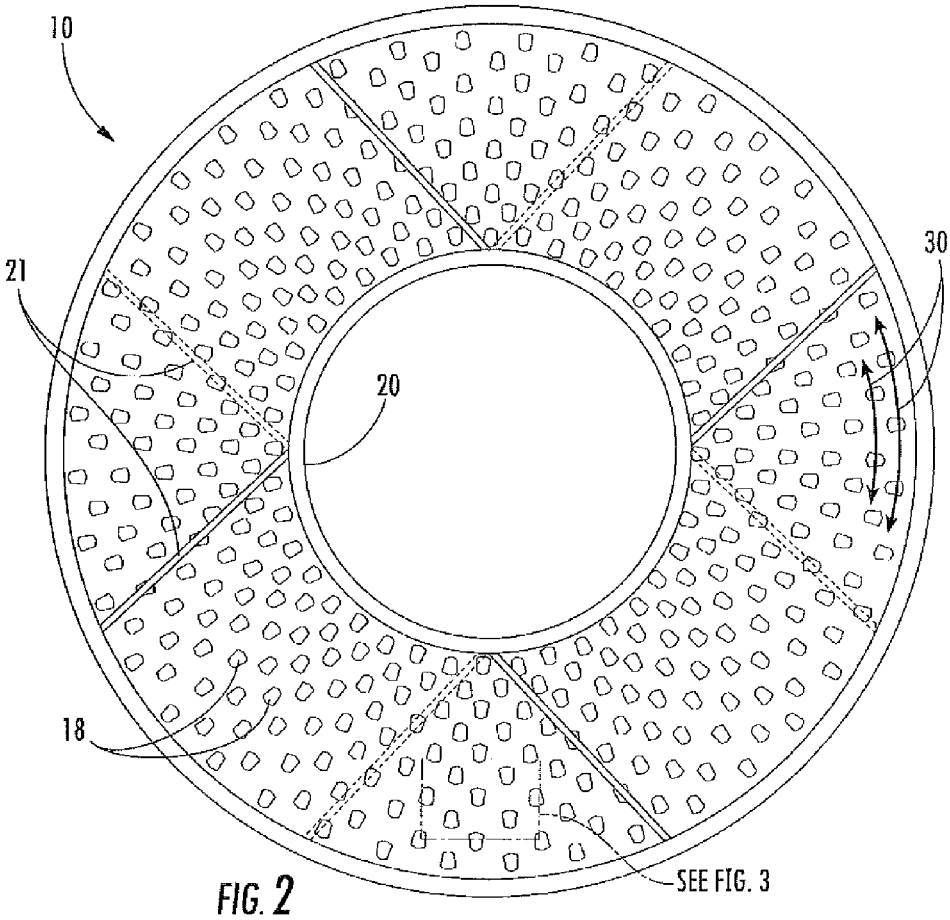
FIG. 2 is a plan view of an extraction bedplate according to one embodiment of the present invention.
Figure 3:
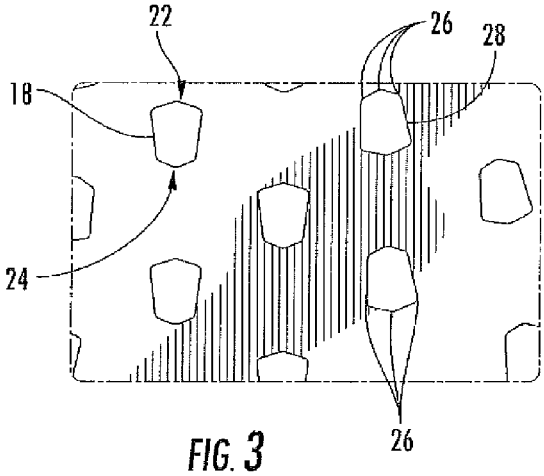
FIG. 3 is an enlarged view of a portion of the extraction bedplate shown in FIG. 2.

FIG. 2 provides a plan view of the extraction bedplate 10 according to one embodiment of the present invention, and FIG. 3 provides an enlarged view of a portion of the extraction bedplate 10 shown in FIG. 2. As shown, the extraction bedplate 10 comprises a body 20 with the apertures 18 passing through the body. The body 20 generally forms a flat, round surface that conforms to or defines at least a portion of the base or bottom of the tub 14. The body 20 may further include one or more wear strips 21 radially arranged on one or both sides of the body 20 that provide an indication of the amount and/or location of wear of the extraction bedplate 10. Each aperture 18 generally comprises a first end 22 and a second end 24 wider than the first end 22. Each of the first and second ends 22, 24 generally includes at least three obtuse angles 26. In this manner, edges 28 between each obtuse angle 26 form a cutting surface for abrading or pulping the papermaking stock. In addition, the obtuse angles 26 enhance the abrasion of the papermaking stock without creating pinch points that may lead to premature clogging or obstruction of the apertures 18.

The apertures 18 may be radially arranged around the body 20 in substantially concentric rows 30, and the apertures 18 in adjacent concentric rows 30 may be aligned with one another or staggered. As used herein, "aligned" means that adjacent apertures 18 in adjacent substantially concentric rows 30 overlap one another in the radial direction, for example by 50% or more in particular embodiments. In contrast, "staggered" means that apertures 18 in one substantially concentric row 30 are generally located between adjacent apertures 18 in the next adjacent substantially concentric row 30, for example overlapping less than 50% as shown in FIGS. 2 and 3. The difference in width between the first end and the second end 22, 24 of each aperture 18 allows the plurality of apertures 18 to be arranged in various patterns that enhance the density of apertures 18 in a given surface area of the body 20. For example, as shown most clearly in FIG. 3, adjacent apertures 18 in the same row 30 may be inverted with respect to one another to fit more apertures 18 in each substantially concentric row 30. Alternately or in addition, adjacent apertures 18 in adjacent substantially concentric rows 30 may be inverted with respect to one another to fit more substantially concentric rows 30 in the body 20.

Figure 4:
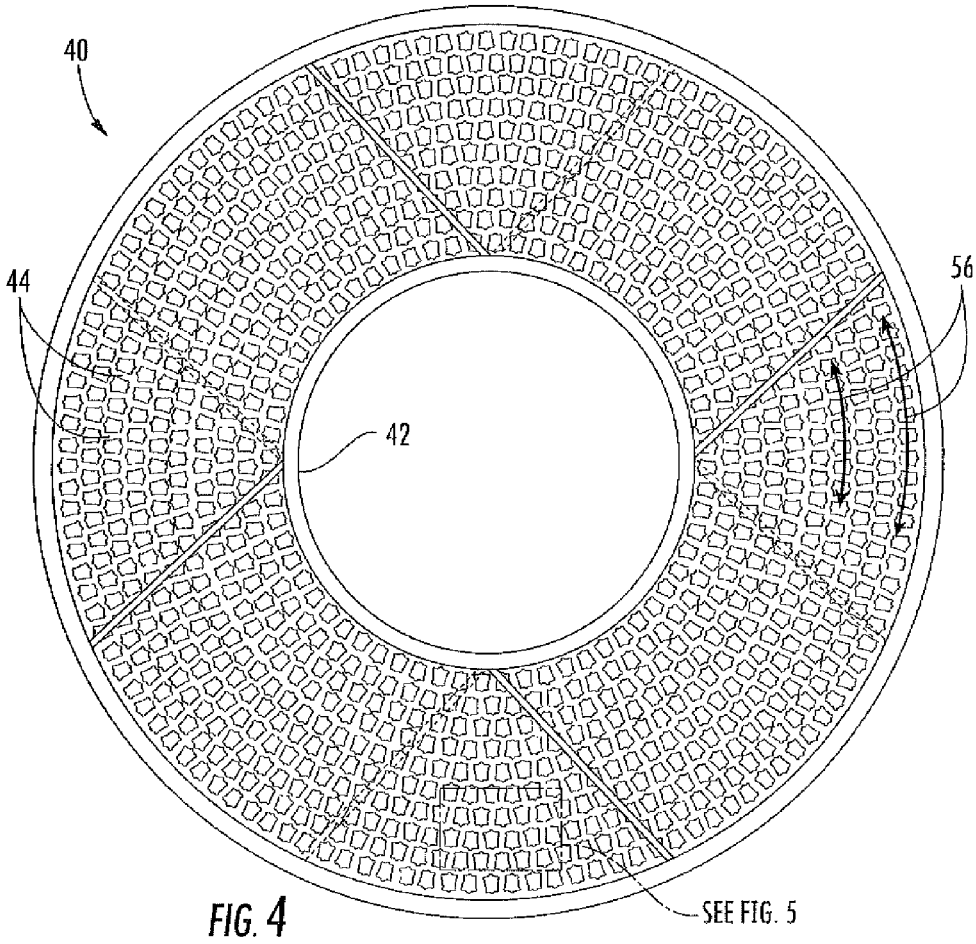
FIG. 4 is a plan view of an extraction bedplate according to an alternate embodiment of the present invention.
Figure 5:
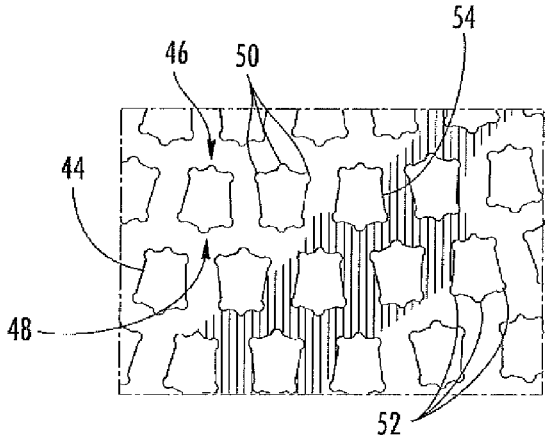
FIG. 5 is an enlarged view of a portion of the extraction bedplate shown in FIG. 4.

FIG. 4 provides a plan view of an extraction bedplate 40 according to an alternate embodiment of the present invention, and FIG. 5 provides is an enlarged view of a portion of the extraction bedplate 40 shown in FIG. 4. As shown, the extraction bedplate 40 again comprises a body 42 with a plurality of apertures 44 through the body 42. Each aperture 44 again generally comprises a first end 46 and a second end 48 wider than the first end 46. Each of the first and second ends 46, 48 generally includes at least three obtuse angles 50, and at least one of the obtuse angles 50 has a rounded vertex 52. In this manner, edges 54 between each obtuse angle 50 form a cutting surface for abrading or pulping the papermaking stock. In addition, the rounded vertex 52 in one or more obtuse angles 50 enhances the abrasion of the papermaking stock without creating pinch points that may lead to premature clogging or obstruction of the apertures 44.

As with the embodiment previously described with respect to FIGS. 2 and 3, the apertures 44 may be radially arranged around the body 42 in substantially concentric rows 56, and the apertures 44 in adjacent concentric rows 56may be aligned with one another or staggered. For example, as shown most clearly in FIGS. 4 and 5, the apertures 44 in substantially concentric rows 56 are aligned with one another so that adjacent apertures 44 in adjacent substantially concentric rows 56 substantially overlap one another in the radial direction. The difference in width between the first end 46 and the second end 48 of each aperture 44 again allows the plurality of apertures 44 to be arranged in various patterns that enhance the density of apertures 44 in a given surface area of the body 42. For example, as shown most clearly in FIG. 5, adjacent apertures 44 in the same row 56 may be inverted with respect to one another to fit more apertures 44 in each substantially concentric row 56. Alternately or in addition, adjacent apertures 44 in adjacent substantially concentric rows 56 may be inverted with respect to one another to fit more substantially concentric rows 56 in the body 42.

A method for manufacturing the extraction bedplates 10, 40 shown in FIGS. 2-5 may include creating the apertures 18, 44 through the body 20, 42 wherein each aperture 18, 44 comprises the first end 22, 46, the second end 24, 48 wider than the first end 22, 46, and at least three obtuse angles 26, 50 in each of the first and second ends. In particular embodiments, the method may further include creating the rounded vertex 52 in at least one of the obtuse angles 50. The body 20, 42 may comprise a metal or metal alloy having a desired hardness for the particular application. For example, the body 20, 42 may comprise 304 or 316 stainless steel or 410 stainless steel having carbon. The apertures 18, 44 may be formed, for example, by drilling using a laser or high pressure water jet. If desired and appropriate, the body 20, 42 may then be heat treated to raise the Rockwell hardness of the surface of the body 20, 42.

As shown in FIGS. 2-5, the method may further include radially arranging the apertures 18, 44 around the body 20, 42 in substantially concentric rows 30, 56 and/or creating the apertures 18, 44 through the body 20, 42 wherein adjacent apertures 18, 44 are inverted with respect to one another. For example, adjacent apertures 18, 44 in the same row 30, 56 and/or adjacent apertures 18, 44 in adjacent substantially concentric rows 30, 56 may be inverted with respect to one another.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An extraction bedplate comprising:

a. a body; and b. a plurality of apertures through the body, wherein each of the plurality of apertures comprises a first end and a second end wider than the first end; and c. at least three obtuse angles in each of the first and second ends.

2. The extraction bedplate as in claim 1, wherein adjacent apertures are inverted with respect to one another.

3. The extraction bedplate as in claim 1, wherein the plurality of apertures are radially arranged around the body in substantially concentric rows.

4. The extraction that played as in claim 3, wherein the plurality of apertures in adjacent substantially concentric rows are radially aligned with one another.

5. The extraction bedplate as in claim 3, wherein the plurality of apertures in adjacent substantially concentric rows are radially staggered with one another.

6. The extraction bedplate as in claim 3, wherein adjacent apertures in each substantially concentric row are inverted with respect to one another.

7. The extraction bedplate as in claim 3, wherein adjacent apertures in adjacent substantially concentric rows are inverted with respect to one another.

8. An extraction bedplate comprising:

a. a body;

b. a plurality of apertures through the body, wherein each of the plurality of apertures comprises a first end and a second end wider than the first end; and c. at least three obtuse angles in each of the first and second ends, wherein at least one of the obtuse angles has a rounded vertex.

9. The extraction bedplate as in claim 8, wherein a plurality of the obtuse angles has a rounded vertex.

10. The extraction bedplate as in claim 8, wherein adjacent apertures are inverted with respect to one another.

11. The extraction bedplate as in claim 8, wherein the plurality of apertures are radially arranged around the body in substantially concentric rows.

12. The extraction that played as in claim 11, wherein the plurality of apertures in adjacent substantially concentric rows are radially aligned with one another.

13. The extraction bedplate as in claim 11, wherein the plurality of apertures in adjacent substantially concentric rows are radially staggered with one another.

14. The extraction bedplate as in claim 11, wherein adjacent apertures in each substantially concentric row are inverted with respect to one another.

15. The extraction bedplate as in claim 11, wherein adjacent apertures in adjacent substantially concentric rows are inverted with respect to one another.

16. A method for manufacturing an extraction bedplate comprising: creating a plurality of apertures through a body wherein each aperture comprises a first end, a second end wider than the first end, and at least three obtuse angles in each of the first and second ends.

17. The method as in claim 16, further comprising creating a rounded vertex in at least one obtuse angle.

18. The method as in claim 16, further comprising creating the plurality of apertures through the body wherein adjacent apertures are inverted with respect to one another.

19. The method as in claim 16, farther comprising radially arranging the plurality of apertures around the body in substantially concentric rows.

20. The method as in claim 19, further comprising inverting adjacent apertures in adjacent substantially concentric rows with respect to one another.

* * * * *